United States Patent [19]

Glock et al.

[11] Patent Number: 4,480,354

[45] Date of Patent: Nov. 6, 1984

[54] ROVING HOLDING MECHANISM FOR DRAW FRAMES

[75] Inventors: Alfred Glock, Stuttgart; Kurt Seebo, Esslingen; Bernhard Schoenung, Filderstadt; Dieter Tkotz, Tamm, all of Fed. Rep. of Germany

[73] Assignee: SKF Kugellagerfabriken GmbH, Schweinfurt, Fed. Rep. of Germany

[21] Appl. No.: 494,639

[22] Filed: May 16, 1983

[30] Foreign Application Priority Data

May 18, 1982 [DE] Fed. Rep. of Germany ..... 3218660

[51] Int. Cl.[3] ..... D01G 31/00

[52] U.S. Cl. ..... 19/0.25; 19/239; 19/244; 19/258; 19/288

[58] Field of Search ..... 19/0.25, 236, 239, 244, 19/258, 288

[56] References Cited

U.S. PATENT DOCUMENTS

| | | | |
|---|---|---|---|
| 563,343 | 7/1896 | Welty | 19/0.25 |
| 655,141 | 7/1900 | Wetmore | 19/0.25 |
| 2,734,335 | 2/1956 | Saunders et al. | 19/288 X |
| 2,956,392 | 10/1960 | Ohnishi | 19/0.25 X |
| 3,537,145 | 11/1970 | Meert et al. | 19/288 X |
| 4,065,831 | 1/1978 | Huntsinger | 19/0.25 |
| 4,095,062 | 6/1978 | Savageau | 19/0.25 X |
| 4,445,252 | 5/1984 | Morihashi et al. | 19/244 |

*Primary Examiner*—Louis Rimrodt

*Attorney, Agent, or Firm*—Murray Schaffer

[57] ABSTRACT

A drawing frame for a spinning machine is provided with a blocking mechanism movable into a position between the upper and the lower feed rollers, in the event of yarn breakage, to lift the roving from contact with the driven roller. The blocking mechanism holds the roving. A roving holder is coupled to the means for actuating the blocking mechanism for synchronous operation and is provided downstream of the inlet roller. It comprises a table extending beneath the roving and a rotatable shaped arm above the roving which arm is movable by the switching mechanism to simultaneously hold the front end of the roving. The table is provided with a guide lug at its free end extending at an upward angle relative to the rotatable arm and the arm is covered with an inclined member having a slope running toward the guide lug. The sloping member and the guide lug are spaced from each other to define an opening which communicates with the space between the supporting table and the rotating arm to thereby automatically cause the roving, which, is laying on the rollers of the drawing frame, to slide into position on the table.

7 Claims, 2 Drawing Figures

ROVING HOLDING MECHANISM FOR DRAW FRAMES

BACKGROUND OF THE INVENTION

The present invention relates to the construction of drawing frames for thread-spinning machines and in particular to apparatus for facilitating the insertion of the roving in a holding device for the roving.

The conventional spinning machine is provided with a drawing frame having at least a set of inlet rollers for receiving the roving or slubbing from a source and a set of exit rollers therefrom and between which the roving is drawn. The exit rollers feed the drawn material, as thread or yarn onto a bobbin or cop on which it is wound. The sets of rollers each comprise a driven lower and a pair of axially spaced twin upper rollers permitting the drawing of two rovings side by side. The upper rollers are journalled in rank pairs on a common supporting load arm extending in the direction of a drawing. Such a machine is disclosed in DE-OS No. 22 57 323 which also provides means for sensing the proper winding of the drawn thread.

In application Ser. No. 335,210 filed Dec. 28, 1981 we have disclosed several safety features, one of which comprises a device for blocking the roving at the upstream rollers when the thread or yarn breaks or ruptures at the downstream end. A holding device is also disclosed in association with the blocking device, but located between the upstream and the downstream rollers which provides a laterally cantilevered table which holds the forward most end of the roving and/or partially finished thread, so as to initially start or restart the drawing frame. Normally, after a break in the yarn, the roving will, by itself, run into the roller or belt pairs of the drawing frame, after which the roving blocking device will be released. However, in those cases where a yarn breakage disturbs the drawing system and effects the running of machine where a breakage of the second yarn also occurs, drafting frame must be opened and it is then necessary to reinsert the roving by hand. The manual insertion is also necessary when a new shipment of roving material must be loaded into the machine.

The present invention has as its object the task of facilitating the placement of the roving onto the roving holder and of assuring that the roving is thereafter placed properly on and in contact with and aligned with the lower rollers so as to come to rest in proper position for the operation of the drawing frame without any manual manipulation being required.

The foregoing objects as well as other objects and advantages are set forth and will be apparent from the following disclosure of the present invention.

SUMMARY OF THE INVENTION

According to the present invention, a drawing frame for a spinning machine is provided with a blocking mechanism movable into a position between the upper and the lower feed rollers, in the event of yarn breakage to lift the roving from contact with the driven roller. The blocking mechanism holds the roving between itself and the upper roller, so as to block its further movement. In addition, a roving holder facilitating holding, in alignment, the tuft end of the roving between the drawing and outlet rollers is provided. This latter apparatus is coupled to the means for actuating the blocking mechanism for synchronous operation and is provided douwnstream of the inlet roller. It comprises a table extending beneath the roving and a rotatable shaped arm above the roving which arm is movable by the switching mechanism to simultaneously hold the front end of the roving.

According to the present invention, the table is provided with a guide lug at its free end extending at an upward angle relative to the rotatable arm and the arm is covered with an inclined member having a slope running toward the guide lug. The sloping member and the guide lug being spaced from each other to define an opening which communicates with the space between the supporting table and the rotating arm to thereby automatically cause the roving to slide into position in alignment with the rollers of the drawing frame.

In the present invention, the roving, when properly placed on the lower rollers will also come to rest on the guide slope projecting onto the placement path for the roller and will depending upon the incline of the slope, the nature of the surface and its own material condition, slide at once automatically toward the opening and slide in between the table and the supporting arm. Thus, the roving will automatically enter in the latter condition and will obtain its proper position in the roving holder with assurance. Once the draw frame is placed into operation and the roving is moved by the inlet rollers, it would automatically be in line with the rollers and thus not require manual manipulation to reset the drawing frame.

Full details of the present invention are set forth in the following description and are illustrated in the accompanying drawings.

RELATED APPLICATION AND DISCLOSURE

In the present disclosure, reference is made to structural features which have been described in greater detail in copending application Ser. No. 335,210, filed Dec. 28, 1981, of which several of the inventors are common to this application, and which is commonly owned. The subject matter of Ser. No. 335,210 is incorporated herein as if more fully set forth.

DESCRIPTION OF THE INVENTION

Figure 1:
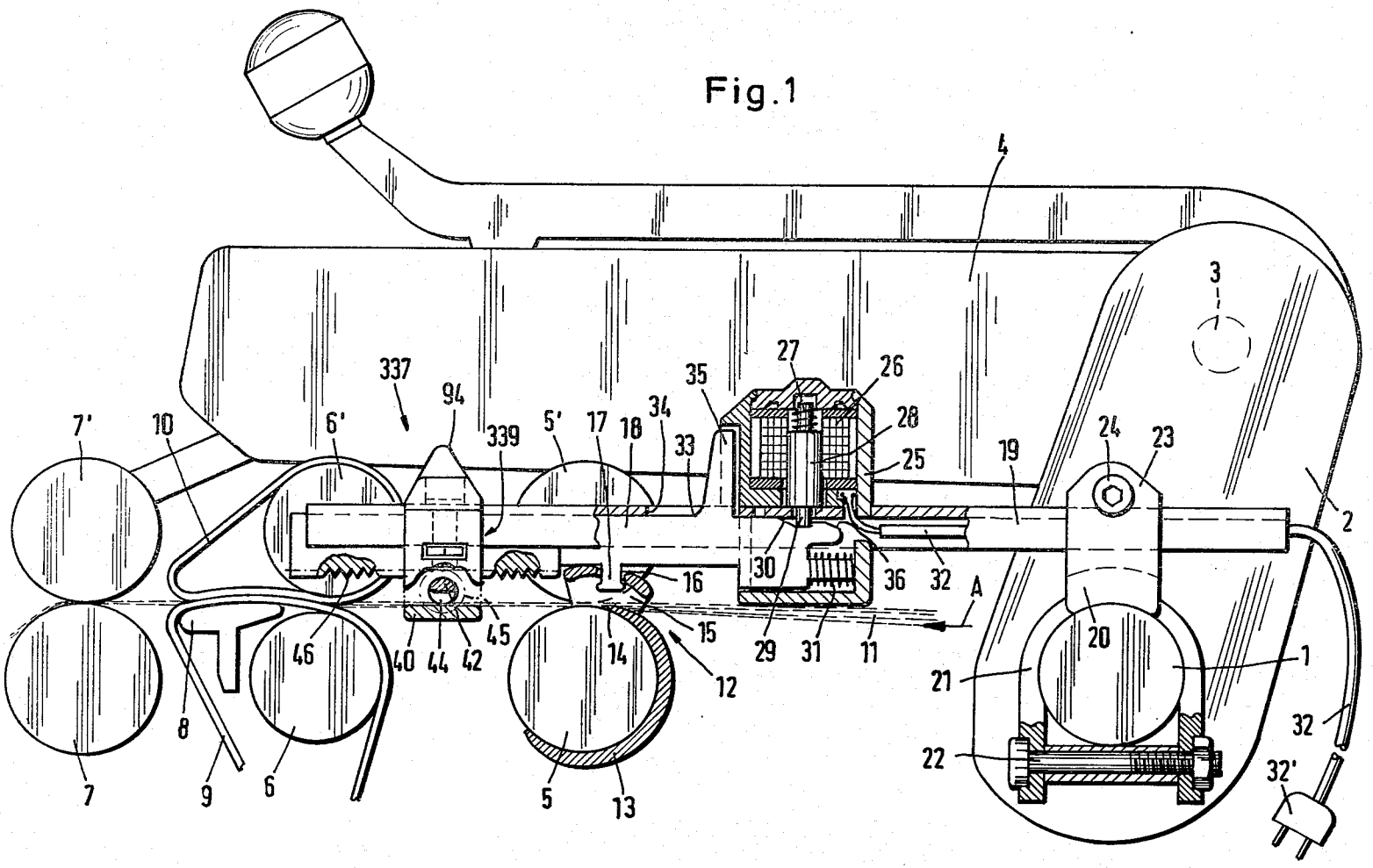
FIG. 1 is a lateral side view of a drawing frame with a partially open roving locking mechanism as well as a roving holder, shown in the position they take during operation of the drawing frame.

The spinning machine, the basic structure of which is well known and therefore not shown in the drawings, is provided with a plurality of drawing frames such as that provided by the present invention and shown in FIG. 1. The frame comprises a supporting rod 1 fixedly mounted to the frame of the spinning machine. A support shoulder 2 is fixedly mounted on the rod and a load arm 4 is pivoted about a bearing 3 journalled in the support shoulder 2.

The load arm 4 shown in its operating position in FIG. 1. The load arm 4 supports a series of twin upper draw rollers 5', 6', and 7', which are freely rotatable about three axles. Mounted also on the machine frame below the load arm are a set power driven lower rollers 5, 6, and 7, matching the twin upper rollers 5', 6', and 7', respectively. A lower belt 9 is entrained over the lower rollers 6 and a bridge 8 while a corresponding upper belt 10 runs over the upper roller 6' and a cage in the corresponding position as the bridge but not shown in the drawing. The roving 11 runs through this frame in the direction of the arrow A.

A thread regulator such as, but not limited to, the disclosure shown in DE-OS Nos. 22 57 323; 21 23 641; and 22 23 638 is provided to sense the thread which is finally formed from the stretched roving. The thread laps itself around a pirn or cop (also not shown). The thread regulator, sensing a break or rupture in the thread, is adapted to release a roving blocking mechanism generally denoted by the reference numeral 12. The blocking mechanism is shown in the non-blocking position, preparatory to movement into the blocking position. The blocking mechanism comprises a partial cylindrical shell 13 placed about the lower roller 5 and embracing its circumference by slightly more than one half. The shell 13 has a tapering edge 14 which is adapted to penetrate between the roving 11 and the lower roller 5 and thereafter raise the roving into contact with the feed roller 5', thereby clamping the roving firmly against the upper roller 5'. The shell 13 is thus prevented from further rotation and the roving 11, which is lifted off the lower roller 5, lies on the edge 14 of the blocking shell 13, while the upper roller 5', which has also been lifted off the lower roller 5, lies on the roving 11 and the edge 14, resulting in the holding of the roving 11 and in the blocking of its further movement.

A radially projecting coupling ear 15 extends from one end of the cylindrical shell 13. The ear 15 has a recess 16 engaged by a coupling projection 17 which depends intergrally from a slide 18. The slide 18 is supported for reciprocal movement, lengthwise, in a rail 19 which has a U-shaped profile along its lower edge. The rail 19 is held cantilevered parallel to the run of the roving by means of a screw 24 in a shoulder bracket 23 on a support arm 20 attached to a mounting bracket 21 which is in turn fixed in position on the support rod 1 by means of a clamping screw 22.

Fastened to the bearing rail 19 usptream of the blocking mechanism 12 is a housing 25 containing an electromagnet 26 having a movable core 28. The core 28 is biased under spring tension by a compression spring 27 at its upper end and is formed with a bolt 29 projecting from its free lower end. The bolt 29 is normally forced by the spring 27 to engage a detent 30 formed on the longitudinal upper edge of the end of the slide 18, which end projects into the housing 25. Depending from the rear end of the slide 18 is a heel having an axially rearward extending spur 31' on which a compression spring 31 bears. The spring 31 is braced against the inner wall of the housing 25 so as to normally press the slide 18 to the left, as seen in the drawing, when the core 28 is removed from the detent 30, against the force of the stop spring 27, by brief excitation of the elctromagnet 26. The electromagnet 26 is connected by means of a plug 32' attached to a cable 32 laid out in the bearing rail 19 leading outwardly from the end of the rail facing the interior of the machine, to a control including a relay switch-controlled by the thread regulator sensor.

If the thread breaks, the pressure spring 31 moves the then unbolted slide 18 to the left until the edge of a handle 35 intergrally extending upward from the upper edge of slide 18 impacts a counteredge 34 formed on the bearing rail 19. The handle 35 projects upward through a slot in the bearing rail 19, and enables the slide 18 to be manually pushed back again against the force of the pressure spring 31 into the readiness or operating position of the roving blocking mechanism, as shown in the drawing. The rear most end of the slide 18 is provided with a cammed incline 36 enabling the slide 18 to easily move the bolt 29 upward to where it finally snaps again into engagement with the detent 30.

Arranged between the twin rollers 5, 5' and twin rollers 6, 6' is a roving holder, generally denoted by the numeral 337. The roving holder 337 serves to hold the fiber tuft created in the upstream end where rupture of the thread is snesed and blockage of the roving occurs. It also assures that the roving runs automatically into the subsequent clamping situs (area of the bolting mechanism) upon restarting of the operation of the draw frame.

Figure 2:
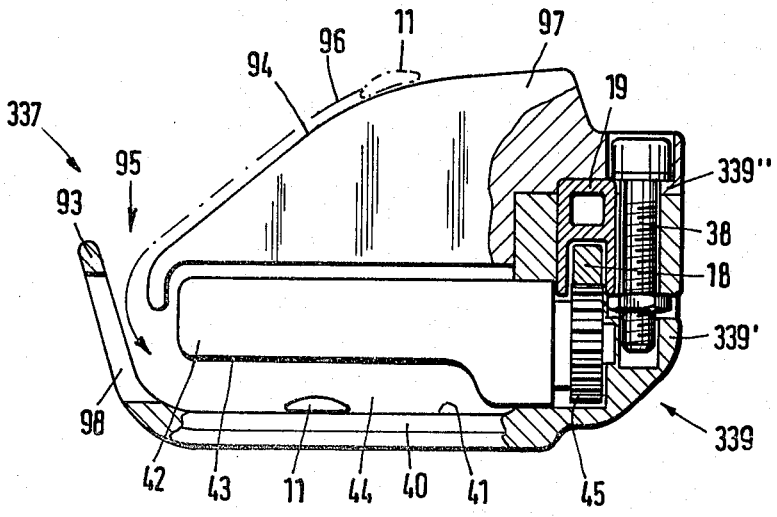
FIG. 2 is a frontal view of the roving holder in partial section.

As can be seen in FIG. 2, the roving holder 337 comprises a holder body 339 formed of a lower and upper part 339', 339'' respectively which provide a recess adapted to the cross-sectional profile of the bearing rail 19, over which it is slidably mounted. Each of the two parts 339' and 339'' contains a segment of the recess embracing the bearing rail 19. A clamping screw 38 is inserted into the two parts of the holder body 339 and with its associated nut holds the two parts 339' and 339'' together and presses them so as to abut firmly on the bearing rail 19 at a selected point along the rail.

The lower part 339' of the holder body is provided with a table 40, laterally projecting cantilevered beneath the normal run of the roving 11. Parallel to the extension of the table 40 and spaced slightly above its surface 41 so as to face the roving 11, is a rotatable arm 42 forming a holding member overlapping, also in cantilevered manner, the roving 11. The arm 42 is capable of being rotated about its longitudinal axis X-X (FIG. 2). As seen more clearly in FIG. 1, the cross-sectional configuration of the arm 42 is generally circular but is flattened to provide a chordal land, on one side over the greatest part of its freely projecting length so that in the rotated position shown in FIG. 2 a gap 44 exists below the flattened land surface 43, through which the roving 11 can move without any obstruction. The inner end of the arm 42 located inside the holder body 339 is provided with a pinion gear 45 which meshes with a rack 46 provided on lower edge of the slide 18 so that it is operated synchronously therewith.

The roving holder 337 is fastened on the bearing rail 19 in such a way that the arm 42, in the locked position of the slide 18 and in the readiness or operative position of the roving blocking device 12 and in the existing mesh of the gear 45 with the teeth 46 is in an adjusted position in which the gap 44 exists between the flattened surface 43 and the table surface 41, allowing free run of the roving.

When the slide 18 is disengaged as when the yarn breaks, the blocking shell moves into the previously described interposition to clamp the roving 11. The slide 18 simultaneously imparts through the rack 46 approximately half a turn forwardly to the gear 45 and thus privots the arm 42 by the same amount. The arm 42 thus turns to place its rounded or non-flattened surface in direct opposition to the surface 41 of the table 40, and at such a close position that the roving 11 is then held fast, and thus clamped in position.

To facilitate the insertion of the roving 11 into the slot 44, the table 40 is turned up at its free end to form a guide lug 93 arranged at an angle relative to the arm 42, and spaced from the end of the arm. The upper holder body 339'' is shaped to provide a guide slope 94 running into the direction of the lug 93. The guide lug 93 and the guide slope 94 define a wedge-shaped opening 95 leading into the slot 44. Now, the roving is manually inserted into the draw frame, when the load arm 4 and the upper rollers 5', 6' and 7' are lifted off the lower rollers, by placing it on the row of lower rollers 5, 6, and 7, with its free end extending beyond the lower delivery roller 7, and the central part of the covering itself coming to rest on the guide slope 94 projecting into the laying path, as indicated in FIG. 2 by the dash-dot representation of the roving 11. After being released, the roving slides, as indicated by the dash-dot arrow 96, along the guide slope 94 towards the opening 95 where it is conducted into the slot 44 by the guide lug 93. The roving 11 then obtains its proper position shown in full lines once coming under positive traction with the rollers on intitiating the operation of the draw frame. To what extent the roving slides into the slot 44 by itself after being released depends on the course or shape of the slope 94, the nature of the surface, and the condition of the roving itself. As can be seen from FIG. 2, the guide slope 94 is a wedge-shaped edge of a massive body 97 formed on the holder body part 339''. Instead of a massive body, a wire or strap-like part exhibiting the outline form of the slope could also be used.

To facilitate the assembly of the arm in the roving holder 337, an opening 98 is provided in the guide lug 93, located in the front of the free fronal end of the arm 42. The opening makes it possible to bring the arm 42 through the lug to and from its assembly site in the holder part 339'', so that it may be cleaned, replaced or reparired.

Various modifications, changes and embodiments have been described. Others will be apparent to those skilled in this art. Accordingly, it is intended that the foregoing disclosure be taken as illustrative only and not limiting of the scope of the invention.

What we claim is:

1. In a drawing frame for a spinning machine converting a roving into a thread having inlet and outlet roller pairs aligned to draw said roving, a blocking mechanism responsive to a break in the thread exiting from said outlet rollers to clamp said roving at said inlet rollers and a roving holder and alignment appparatus located between said inlet and outlet rollers comprising a table mounted cantilevered below said roving and a shaped arm mounted above said roving, said arm being rotatable synchronously with said blocking mechanism into a first position to hold the end of the said roving to said table, and into a second position to permit said roving to pass freely therebetween, and a cover above said arm, said cover being inclined and cooperating with said table to cause the roving when placed thereon to automatically slide thereover into position between said table and said arm.

2. The apparatus according to claim 1 said table is provided with a guide lug at its free end extending upwardly at an angle to said arm, said cover having an inclined surface directed towards said lug, said lug and said cover defining a wedge-shaped opening leading to the space between said table and the arm.

3. The apparatus according to claim 2, wherein said guide lug is provided with a hole extending transversely therethrough in the area facing the free end of said arm.

4. The apparatus according to claim 2, wherein said drawing frame includes a bearing rail extending above and along the length of said frame in alignment within said rollers, said apparatus including a body adjustably securable on said rail, said table extending intergrally from said body and said cover being formed on said body.

5. The apparatus according to claim 4, wherein said cover is intergrally formed with said body.

6. The apparatus according to claim 4, wherein said holder body comprises two parts, said table and said arm being arranged on one part and the cover arranged on the other part.

7. The apparatus according to claim 6, wherein both parts of the holder body are provided with recesses engaged by the bearing rail.

* * * * *